US008708354B2

(12) United States Patent
Young

(10) Patent No.: US 8,708,354 B2
(45) Date of Patent: Apr. 29, 2014

(54) CASTER SKATEBOARD

(76) Inventor: Dow Young, George, UT (US)

( * ) Notice: Subject to any disclaimer, the term of this patent is extended or adjusted under 35 U.S.C. 154(b) by 65 days.

(21) Appl. No.: 13/373,446

(22) Filed: Nov. 10, 2011

(65) Prior Publication Data

US 2012/0161409 A1 Jun. 28, 2012

Related U.S. Application Data

(60) Provisional application No. 61/456,845, filed on Nov. 12, 2010.

(51) Int. Cl.
*A63C 17/01* (2006.01)

(52) U.S. Cl.
USPC ..... 280/87.042

(58) Field of Classification Search
USPC ..... 280/87.041–87.043
See application file for complete search history.

(56) References Cited

U.S. PATENT DOCUMENTS

| | | | | |
|---|---|---|---|---|
| 8,047,556 | B2 * | 11/2011 | Jang et al. | 280/87.042 |
| 2007/0257460 | A1 * | 11/2007 | Tsuchie | 280/87.042 |
| 2010/0171280 | A1 * | 7/2010 | Hadley | 280/87.041 |

* cited by examiner

*Primary Examiner* — Jeffrey J Restifo
*Assistant Examiner* — Erez Gurari
(74) *Attorney, Agent, or Firm* — Stan Jones, Patents

(57) ABSTRACT

This skateboard invention has novel swiveling caster wheels mounted on a cross carriage (axle) holding spaced apart swivel caster wheels in place on the undersurface of the board by fixed in place fastening brackets. Dual front and dual rear caster wheels—two in front and two in the rear—as well as a three caster wheeled skateboard is disclosed. Inwardly directed axle stubs (angled toward the center of the board, front and back) are employed with said stubs holding long front and long rear caster arms with wheel hubs supported by the long caster arms. A centering movement for the cross axles—whether front and/or rear—and each caster wheel is disclosed such that the cross axle and/or wheel returns itself to an initial straight line position.

15 Claims, 4 Drawing Sheets

Fig. 6
Fig. 6A
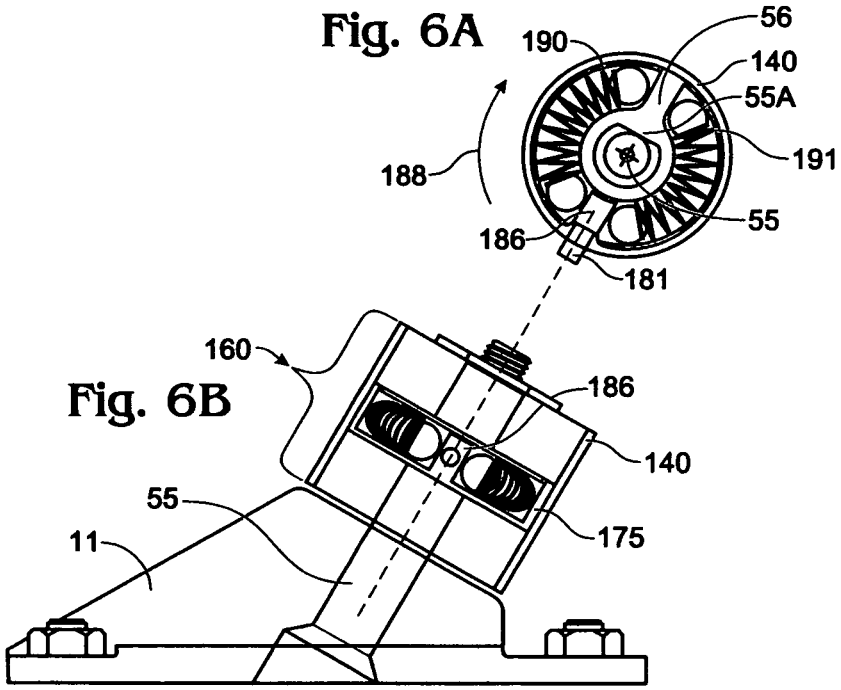
Fig. 6B
Fig. 7
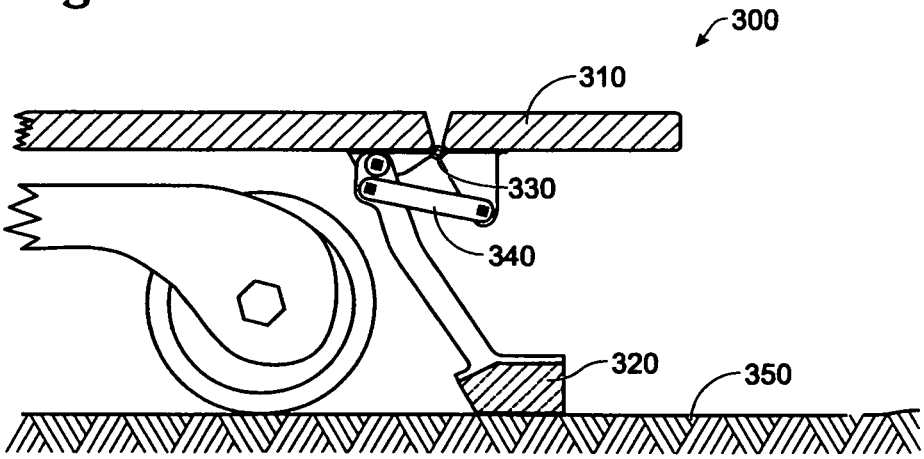

CASTER SKATEBOARD

This is a regular patent application that is being timely filed within the one year period allotted from a Provisional Application Entitled "Three Caster Skateboard" as filed on Nov. 12, 2010 having the same inventor as hereof and awarded Ser. No. 61/456,845.

FIELD OF INVENTION

This invention relates to the field of sports and the sport of skateboarding in particular. A new method and an improved apparatus are disclosed. This invention improves a known sport while providing a new method and structure that has many advantages over known prior art skateboards. The apparatus finds particular strength in regard to a self forwarding, narrow caster wheeled skateboard that "walks" and does not require the user to push off in order to get the board moving. Instead, the board invention "walks" itself forward in response to user weight. Such weight is amplified by shifts—in a move similar to a twisting dance step—from one side of the board to neutral and onto the opposite board side. Such weight shifts amplify the natural forward force on the board.

BACKGROUND OF THE INVENTION

A skateboard is a small piece of wood in the shape of a surfboard with predominantly four non-swivel wheels attached to it. A single person rides the skateboard, guiding and initiating movement by his feet. While some skateboards are useful as transportation over short distances, most skateboards are used to perform stunts.

Skateboards consist of three parts: the deck (the actual board), the truck (a component usually made of metal that holds the fixed wheels to the deck), and the wheels. The average skateboard deck is about 32 in (81.3 cm) long, 8 in (20.3 cm) wide, and is a little less than 0.5 in (1.3 cm) thick. The deck has a defined nose and tail end with a generally concave section in the middle. Skateboard wheels are usually made of polyurethane and range in width from about 1.3-1.5 in (3.3-3.8 cm). While nearly all skateboards have similar shapes and characteristics, their dimensions vary slightly based on use. There are skateboards built for speed, slalom, and freestyle.

Historical Background

Though there is unconfirmed evidence that a skateboard-like apparatus existed as early as 1904, the more commonly accepted predecessor to the skateboard was created in the 1930s. In Southern California, a skate-scooter was made out of fruit crates with wheels attached to the bottom. This evolved into an early skateboard that was made out of 2×4 ft. (61×121.9 cm) piece of wood and four fixed metal wheels taken from a scooter or from roller skates. This early version of the skateboard featured rigid axles and fixed wheels.

Recognizable skateboards were first manufactured in the late 1950s. These were still made of wood and a few were decorated with decals and artwork. Skateboards became especially popular among surfing enthusiasts, primarily in California. Surfers practiced on skateboards when the ocean was too rough, and they became known as "sidewalk surfers."

There was a renewed interest in skateboards when wheels made of polyurethane were introduced. These early polyurethane wheels were composites of sand-like material that was formed into a flat and wide wheel with an adhesive binder under extreme pressure. With the advent of such polyurethane wheels, boards became easier to control and more stunts were possible.

Subsequently, skate parks were introduced. Skate parks were specially designed places that catered specifically to skateboarders. Popular interest in skateboarding increased due both to improvements in technical innovation and skateboarding videos which featured skateboarders performing extremely difficult and dangerous stunts using ramps, stairs, handrails and the like. New interest in the sport resulted. High-profile exposure like ESPN and MTV's X-Games and skateboard competition added increased interest in the sport. Televised events of "extreme sports" showed the best of many kinds of skateboarding. Skateboarding was regarded as the first extreme sport.

Skateboard technology has also continued to evolve. Skateboard manufacturers experimented with different thicknesses of veneers for the decks, but practically speaking, very little has changed in the actual manufacture components of skateboards until this invention.

Raw Materials

Most skateboard decks are made of glue and wood (usually maple), but some are made of composites, aluminum, nylon, Plexiglas, fiberglass, foam, and other artificial materials. Skateboard trucks are usually made of aluminum or other metal (steel, brass, or another alloy), though a few are made of nylon. These trucks, in all prior art skateboards, are fixedly mounted on a vertical post fastened or formed in the bottom of the board.

To assemble a skateboard, the maker also needs ball bearings (usually full precision and made of metal) and a sizable piece of grip tape. Grip tape comes in a sufficiently large piece—bigger than the deck—and looks like a piece of sandpaper. It is secured to the top of the deck, friction surface upward, to provide traction for the user's feet.

FEATURES OF THE INVENTION

Particular attention is directed to the chassis underneath the upper board surface. The improved chassis of this invention has an angled front and an angled rear axle stub to which are attached narrow caster type wheels with a rounded traction surface. Such caster wheels are further characterized as having a pair of support arms swivel mounting said wheels to mounting stubs supported by the underneath surface of the board and behind which the caster wheels themselves follow and swivel.

In the invention the mounting posts, or studs, are bracket mounted at central positions at the front and at the rear of the board proper. These studs are spaced apart and are mounted centrally along the longitudinal axis which runs the length of the board and are leaning inward so that they face each other. The angles which these studs make with the plane of board surface are selected between 20 degrees and 40 degrees for the rear casters and about 60 degrees for the front caster.

The mounting angles change for different performance characteristics. The steeper the angle, the more the wheels and the board leans. Simply stated, angles control the performance characteristics for the board. Accordingly, this orientation, together with other novel features described and depicted herein, provides for improved stability. The novel combinations as described herein are responsible for added versatility in movement and turning maneuvers that may readily be accomplished by this caster wheeled skateboard invention.

Several new features, neither shown nor suggested by prior art skateboards are presented by this invention. First, novel swiveling caster wheel embodiments—rather than fixed wheels—are employed. Second, a carriage cross (axle) holding two spaced apart swivel caster wheels is held in place to the undersurface of the board by fixed in place fastening brackets. Dual front and dual rear caster wheels may be employed. The board, however, does not turn as sharply with a total of four caster wheels—two in front and two in the rear—as compared to a three caster wheeled board. Third, inwardly directed axle stubs (angled toward the center of the board, front and back) are employed with said stubs holding long front and long rear caster arms with wheel hubs supported by the long caster arms. A unique combination of technical features allows for a sizable and novel turning and performance movements as provided by the invention.

A full 360 degree swivel movement is available in the front of the board for a three-caster wheel embodiment. Downward weight on such a caster wheeled board is translated to a forward force on the board simply in response to such downward weight or force. A distinguishing feature of a caster wheel skateboard is the necessity of a centering movement for the cross axles—whether front and/or rear—such that the cross axle returns to a straight line position. Extra maneuverability is achieved by caster wheels, and the return-to-center structure for the cross axle is a significant feature for a caster wheeled skate board.

Standard prior art boards with fixed wheels do not face this wheel and axle centering problem, nor do they achieve the flexibility and significant accomplishments of the invention.

Several embodiments of a caster wheel axle return-to-center position direction feature are presented herein. As described, each has as its basic structure, a version of spring loading in order to assure a self centering position for the caster axles and individually for all of the caster wheels. Additionally the extreme maneuverability of this skateboard invention has warranted, or required, a braking mechanism. A skateboard braking mechanism of this invention is readily activated by the user's heel. Other new and novel features will readily become apparent as the caster skateboard invention is described and claimed in more depth.

I am enclosing herein several drawing figures that assist in understanding and appreciating the description and the principles of my invention. Each Figure is numbered and each demonstrates new and unique features that are described in my written description. This patent application drawing is identified and discussed herein by appropriate Figures and is provided with number designations in order to further exemplify the novelty of the invention.

DESCRIPTION OF THE FIGURES OF THE DRAWING

FIG. 6 includes FIGS. 6A and 6B which together depict another return-to-center position embodiment for my invention; and FIG. 7 supplies some additional operational views helpful in understanding the braking system of the invention.

DETAILED DESCRIPTION OF THE INVENTION

Figure 1:
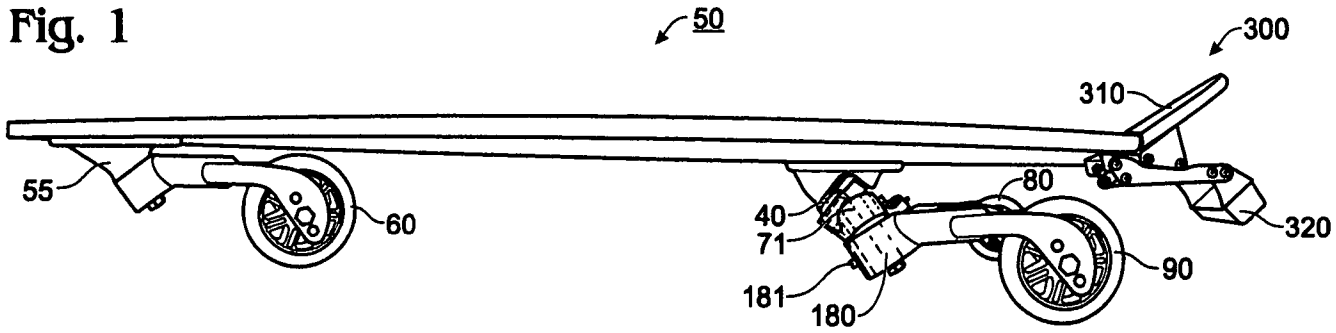
FIG. 1 is a side perspective view looking down on my three caster-wheeled skateboard invention.

I will describe the apparatus and process involved by reference first to FIG. 1. FIG. 1, a side perspective view, depicts board 50 having a total of three caster wheels 60, 80 and 90. Other inventive embodiments may have a total of four caster wheels with a pair of long caster wheels both in front and in the rear. Each caster wheel is characterized by having a swivel mounting on an angled stub fastened into or formed in the underside of board 50. Front stub 55 is angled slightly to the rear while rear stub 70 is angled toward the front of the board.

Figure 2:
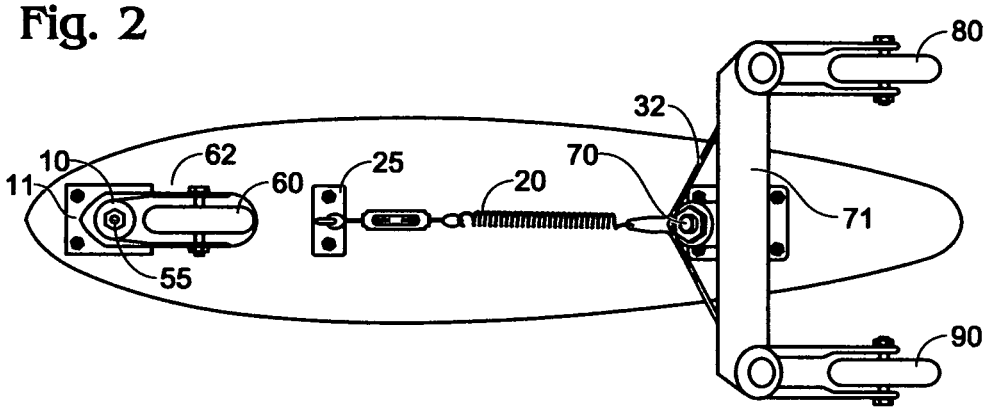
FIG. 2 depicts the underside of a development board and clearly shows a front caster, and a pair of rear casters together with an embodiment of a return-to-center position structure for the rear truck and axle configuration.

FIG. 2, a development model without a brake assembly 300 of FIG. 1, supplies more operational detail. In FIG. 2, front caster 60, housed in cantilever yoke 62, is swiveled for full rotation about the angled stub 55. The flexibility and stunt-performing capability of this board 50 is perhaps mostly attributed to the rear dual caster truck comprising stud 70 and cross axle 71 that carries caster wheels 80 and 90. Cross axle 71 is swivel mounted on a central stub 70 that is angled toward the front of the board 50.

In accordance with the principles of my invention, there is in this embodiment a centering spring 20, FIG. 2, which is turnbuckle connected at one end beyond the center of the board at fastener 25. The other end of centering spring 20 is connected by Y brace 32, which brace is rigidly linked to the cross arm or axle 71. The actual swivel movement of the rear truck and caster wheels may be limited in part by the wheels either contacting the side of the board when turned too far, and/or by the centering spring assembly 20 which prevents overly large swings. With too large swings, the board will simply tip over. As it is, the board 50 turns very sharply and is capable of executing extreme stunts including 360 degree circles by the rider.

Returning briefly to FIG. 1, the distance between the mounting stub 55 and the axis for caster wheel 60 is about five to six inches. Weight shifts on the board cause a twisting (leverage) motion on the wheel's axle (and on the caster wheels themselves) which fixed wheel skateboards just do not exhibit. Casters for this invention may be referred to as "long" casters because the forks or yoke 62 are long in distance between the mounting point and the wheel axle itself. In shorthand technical terms, these long casters travel "higher uphill or higher downhill" as explained in more detail by reference to FIG. 5 hereafter. And, that "uphill" and/or "downhill" movement is what makes this caster wheeled skateboard invention develop a move forward force on its own. The higher up hill each caster wheel travels, the more forward force the board provides on its own momentum as the caster wheels return to center position or direction.

The upper surface of board 50, FIG. 1, receives a user in the normal fashion facing generally sideways, but looking forward, with the user's feet spread apart slightly. As the user shifts his/her weight, the board will, on its own, start to "walk" in response to such user weight shifts. This "walking" for a three caster board, involves first one rear caster moving forward, followed by the other rear caster moving forward. Both movements are in response to weight shifts by the rider using the board. In other words, one does not have to "shove" or "push off" in order to get the board moving. Instead, it will start forward on its own ("walks") as the rider shifts his/her weight in a twist type movement.

This novel "walking" movement by the board is first disclosed and taught by the principles of this invention. This "walking" feature is depicted best in FIG. 5 which includes some side-by-side views, depicted at the bottom, middle and partial top views of FIG. 5. Taken as a whole, FIG. 5 shows the manner in which the board tilts and moves in response to weight shifts by the user.

Figures 5, 5A, 5B, 5C, 5D:
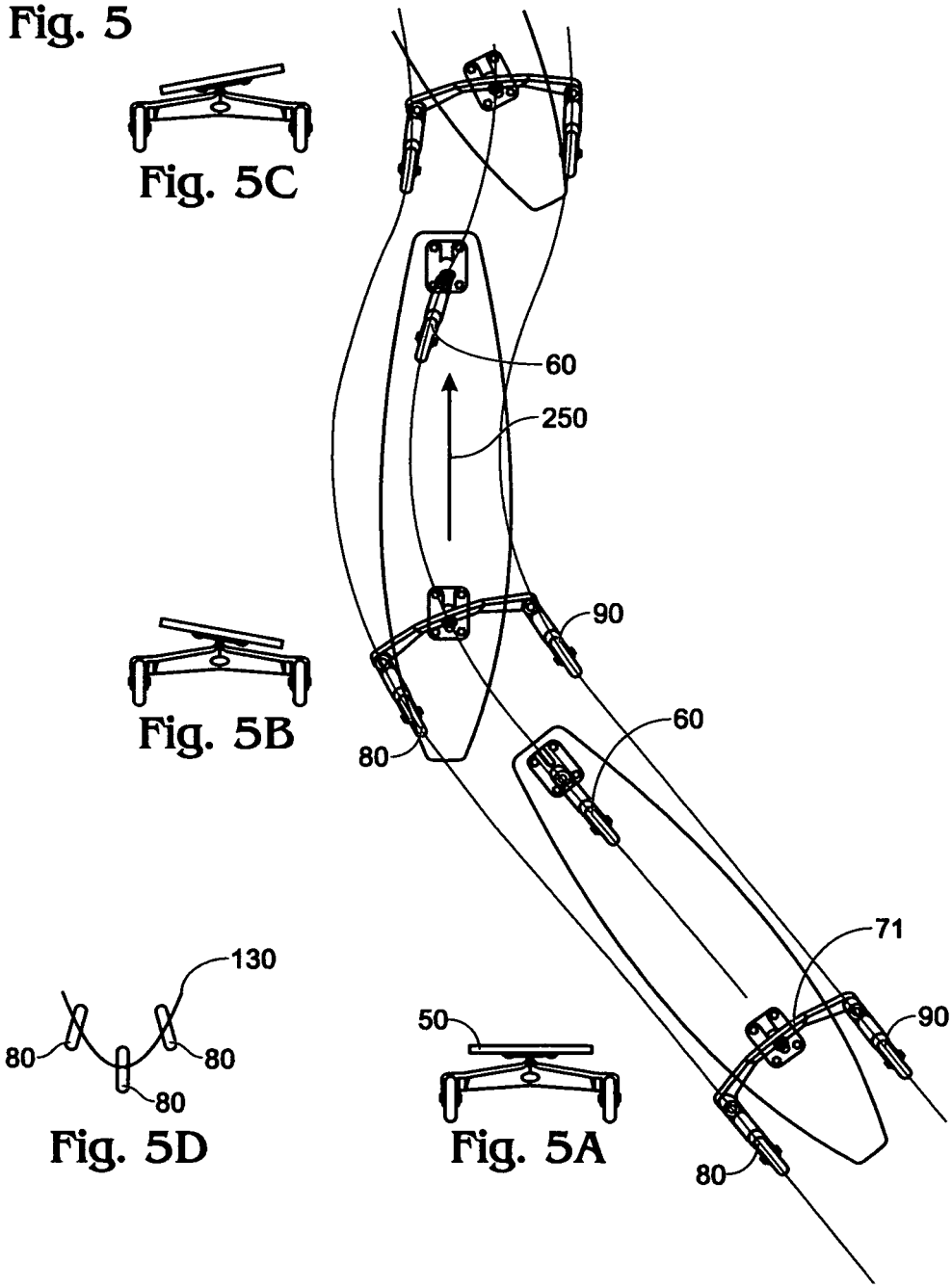
FIG. 5 includes FIGS. 5A, 5B, 5C, and 5D and exemplifies a "walking" movement of my skateboard invention.

Look first at the bottom side by side view FIG. 5A, of FIG. 5. Please understand that the bottom end view, FIG. 5A, of the board 50 is shown in a balanced, or neutral, weight situation. The caster wheels in this condition are in a straight or neutral position. The middle and top end views, FIG. 5A and FIG. 5B, of board 50 show how the board tilts when weight, applied on opposite board sides, causes board 50 to shift away from a neutral position and begin its forward motion.

At FIG. 5A is a situation where the user's weight is evenly, or neutrally, balanced. This is shown by the end view whereby board 50 is shown as level. Accordingly, the straight forward movement for the board 50 would be along the direction shown by arrow 250. This is a balanced or neutral condition for the board In the middle of FIG. 5, at FIG. 5B, the user's weight has shifted heavily to the right hand or inside side edge, and the board 50 has tilted down on the right as shown (Looking, of course, at the rear end of board 50). Note then, that the rear caster wheel 90 moves forward on the board's tilted side in response to that weight shift. Accordingly, the rear caster wheel 90 moves forward, and relatively speaking, the left hand caster wheel 80, in essence, has dropped back. Board 50 thus swings to the inside right as would be expected due to the extra weight on that side.

Please note that the front caster wheel 60 swivels or pivots in a direction that is opposite to the pivoting direction of the rear caster wheels on axle 71. This difference in pivot direction makes for a smooth transition between turns, and sets the general direction of the board's movement. Thus, contra steering by opposite pivot directions of front and rear caster wheels has a valuable result not heretofore experienced in this art.

Summarizing then, the rider's weight on one edge of board 50, causes axle 71 to swivel on its own in response to that extra weight on that side of the board. Indeed, both caster wheels 80 and 90 have climbed "up" hill as shown the wheel outlines on arc 130 in FIG. 5D. Then, as the user shifts his weight toward the other side of the board, the rear axle swivels the other direction on arc 130 and the caster wheels come "down" hill. This "up" hill followed by a "down" hill movement is what causes a force which moves board 50 forward in a direction along arrow 250.

Step by step, the board "walks" on its own in response to rider weight shifts. Each weight shift thus results in a new "up hill" movement followed by a "down hill" movement that creates additional forward force for board 50. The caster wheels and axles of this invention achieve this totally new result. Results not known before or contemplated by the fixed wheel prior art skateboards are achieved by the invention. Other new and improved features will readily be appreciated by the reader as the invention is more fully described herein.

Fastener 25, FIG. 2, anchors centering spring assembly 20 in place. An exterior spring-turnbuckle assembly 20 may tend toward damage due to extreme stunts and maneuvers. The spring assembly 20 is safer if concealed. What is essential, however, is that the same return-to-center position function and associated structure takes place for board 50. Other centering forms of the invention, as disclosed herein, may be employed such as those self contained in the housing 42 of FIGS. 4 and 6.

Figure 4:
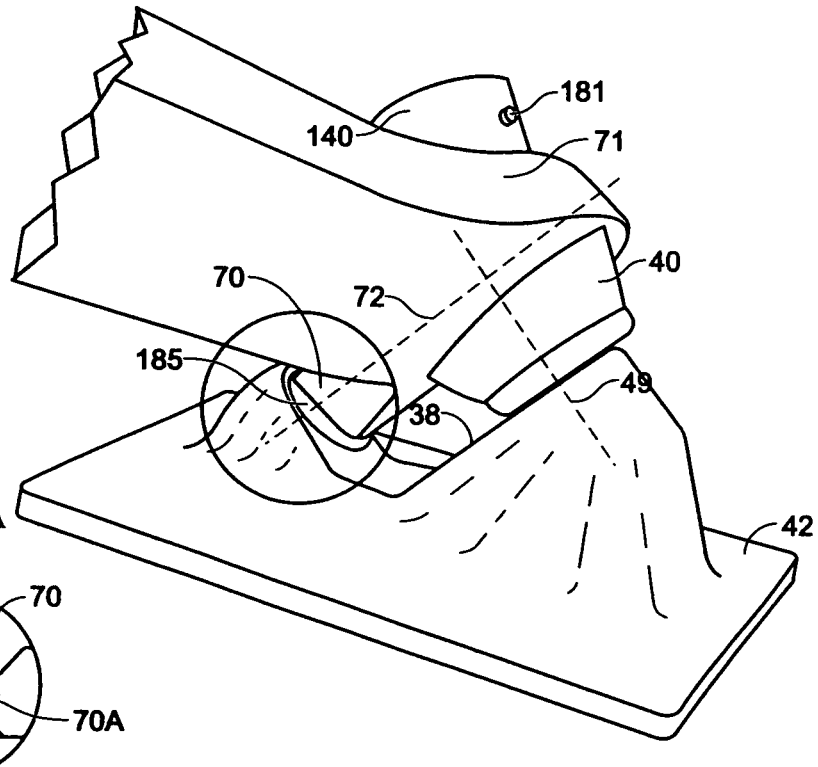
FIG. 4 depicts a partial cutaway view of a dual mounting bracket fastened on the underside of the board with one mounting for the stud holding the rear axle and the other mounting for a return to center position embodiment of the invention. This FIG. 4 also includes FIG. 4A which is an enlarged cross section of a portion of the mounting bracket, which enlarged cross section depicts figuratively a downward weight absorbing assembly for angled downward forces as initiated by rider weight shifts.

Bracket 42, FIG. 4, is a dual mounting structure for two distinct shafts. One shaft is the mounting stud 70 that is on an axis 72 that leans toward the center of the board 50. Stud 70 is actually an anchoring stud or king pin machined in, or otherwise formed in the yoke-shaped portion of cross axle 71. This protrusion of axle 71 is seated in an appropriate receiving opening aligned on the mounting axis 72 formed in a shoulder on bracket 42.

Note that both of the mountings in bracket 42 are on axes that intersect one another at a right angle, with one axis leaning forward (mounting stud axis 72) and one axis (return shaft axis 49) leaning rearward. Rear axle 71 swivels right or left about a central hole therein which is secured by a nut 48, FIG. 3, riding on the top of axle 71. Hole 48 aligns with and is seated over the threaded shaft 49 of the return to center system which is on axis 49, FIG. 4.

Rubber bushing 40 will be compressed equally for a neutral position initially and that bushing will further compress on one side or the other as weight shifts by the rider take place. Bushing 40, however, always tries to urge axle 71 back to a neutral or balanced condition.

Caster wheels normally have a 360 degree turning ability. The caster wheels of the invention don't turn that far because I have provided a caster wheel limiting and centering function that does not allow the wheels to swing to that extreme. Indeed, all three casters have a centering function mounted within the swivel housings 10, 30 and 35 of FIG. 3. Such structure restricts the turning ability of these casters 60, 80 and 90 to about 90 degrees.

Figure 3:
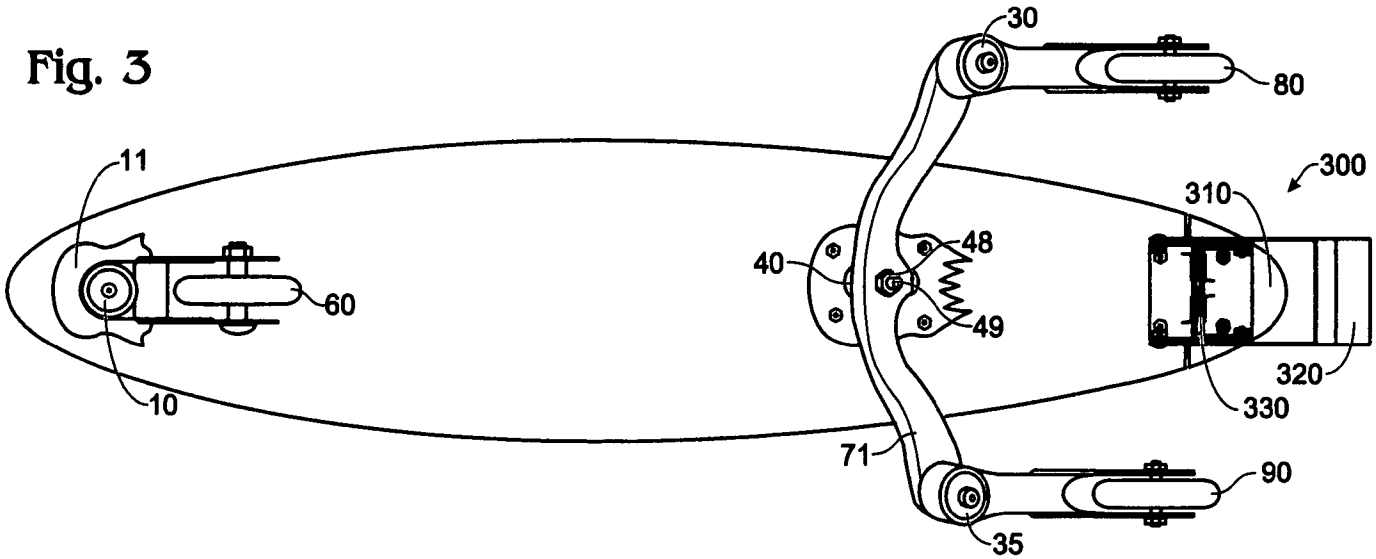
FIG. 3 depicts another underside view having a second return-to-center or return-to-neutral structure for the rear truck and axle configuration and discloses structural detail about the underside of the brake for the skate board of the invention.

Swivel bearings 10, 30 and 35, FIG. 3, are employed for each caster wheel 60, 80 and 90. Note in FIG. 3 that the caster wheels are thin and rounded for smooth turning and stunts about the swivel bearings provided for all caster wheels. These swivel bearings allow the caster(s) to smoothly swivel within fixed limits. Each bearing is a group of three bearings stacked one above the other on a common central axis as is described in greater detail hereinafter. Briefly, however, the upper and lower bearings of each bearing group are standard smaller-sized ball bearings. The middle position bearing of each group is actually a return-to-neutral or center position bearing.

The bearings for board 50, such as bearing groups 10, 30 and 35 each have a return to center structure located within them. Furthermore, such bearings also restrict the amount of swing for the wheels 60, 80 and 90. Clearly wheels 60, 80 and 90 swing both right and to the left, but the caster wheel motion for the invention is more complex than that.

Each caster wheel travels in an arc shape as symbolically shown by the upward curved arc 130 presented in the drawing of FIG. 5D of FIG. 5. For straight travel, the caster wheels 60, 80 or 90 are at the valley of its own arc. Weight shifts moves the wheels away from that valley or center position. Thus, pivoting of weight by the rider, either right or left, results in the wheels actually travelling up hill as it swings along arc 130, FIG. 5D, from its neutral position. When the board is in use and the wheels are in contact with the skate surface, such wheel movement translates to a forward force for the board itself.

A downward force applied to the board provides enough rotating motion to the caster wheels that the board 50 will be propelled in a forward direction. Understand that this forward motion to board 50 is done on its own in response to a downward force (rider's weight) on the board. Twisting weight shifts by the rider further amplify this forward movement and the board is off and rolling without any necessity for the rider to push off.

A caster wheeled skateboard requires a return to center structure for reasons of safety and practicality. Another embodiment of a return-to-center device is depicted in FIG. 6. This embodiment, which may be embedded within bracket 42 of FIG. 4 (or bracket 55 of FIG. 1) acts as a return to neutral structure. In either case, however, such structure and function is associated with mounting stub 70 for rear axle 71, FIG. 4. This return to center employs a principle of operation which is basically the same as that described for FIG. 2. While FIG. 2 relies upon an externally visible spring 20, the centering of FIG. 4 is contained out of sight in a bearing group 160 to be described in connection with FIG. 6.

Each caster wheel is outfitted with a bearing group 160 for a smooth transition between maneuvers. Every caster must pivot and return to neutral after the transition. Additionally, each caster wheel must bear the weight of the rider and yet smoothly turn as required for stunts and enjoyment of use. FIG. 6 includes FIGS. 6A and 6B which respectively are a side and a top view of a bearing group 160. Such a group would, for example, constitute one bearing each for both the front and rear caster wheels 60, 80 and 90 of FIG. 1. Assume, for discussion purposes, that the structure shown in FIG. 6 is for a front caster wheel 60, FIG. 3.

FIG. 6 depicts a cutaway top and side view with the top view looking into an individual return to center bearing 175 of the bearing group 160. Middle position bearing 175 is seated in an outer housing 140, which housing 140 forms part of the spoke ("yoke") arms for caster wheel 60. FIG. 6 shows a similar portion of this outer housing 140 which also show an Allen screw 181, which screw connects the outer housing 140 to an inner divider stub 186.

As a caster wheel, such as wheel 60, FIG. 1, pivots, the outer housing 140 rotates with it. Reference to FIG. 6A discloses that the inner stub 186 receives an Allen screw 181 through housing 140. Thus, components 186 and housing 140 are rigidly fastened together, and both rotate as a single unit.

Mounting stud 55 is shaped with a flat surface 55A such that divider 56 is fixed in position within outer housing 140; and housing 140 rotates about a divider bridge 56 and stud 55. Divider 56, as shaped, becomes in essence, part of stud 55. As best depicted in FIG. 6A, some—or all—of the race space normally occupied by ball bearings has been replaced instead by strong springs 190, 191 and a limited number of ball bearings positioned at the extreme ends of the springs. Clearly if the springs 190, 191 occupy all of the race space no ball bearings are present at all. I have found that each option provides satisfactory results. Regardless of the set up, however, each such spring is nestled within each half of the race. These springs 190, 191 are in a balanced state when the housing 140 and its attached caster wheel 60 are in a center, or neutral, position. That neutral position defines a continuing straight forward motion.

Springs 190 and 191—when either spring is compressed—act as a centering spring in order to move the housing 140, and therefore the caster wheel, such as 60, FIG. 1, back to a standard center position. The operation is as follows. Swivel movement, left or right, FIG. 6, creates a compression build up in one spring (say spring 190) and an expansion or lengthening of the other spring, 191.

For example, a clockwise rotation of caster wheel 60 results in a corresponding clockwise rotation of housing 140 as shown by arrow 188, FIG. 6A. Such a rotation will compress spring 190 and lengthen spring 191. Centering spring 190 then resumes its normal condition and will move the housing 140 back to its initial position. Thus, concurrently with the user's weight shift back to a balanced, or neutral direction, for board 50, spring 190 expands back to an initial condition. Board 50 is thus returned to its balanced straight ahead configuration.

Referring again to FIGS. 3 and 4, a dual mounting bracket 42 is depicted. Two separate mounting axes are defined by the bracket 42. One axis 72 is along the stud 70 which holds axle 71 in place. The other axis 49 is along a shaft 48, FIG. 3, that houses a single rubber bushing 40 between the underside of axle 71 and the shaft seat in an angled shelf 38 formed or otherwise affixed in bracket 42, FIG. 4.

These two axes are at right angles to each other and operate together with the structure as shown which serves to bring axle 71 back to center. Thus bracket 42 is both a supporting and a return-to-center structure for rear axle 71. Although not shown, a pair of rubber bushings, such as 40, may be employed on both sides of the axle hanger 71 in order to absorb the twisting motion caused by a rider. If, however, the force caused by the rider is too great, twisting in the board may cause a pair of rubber bushings to separate and wear excessively.

I found that by replacing an upper rubber bushing with a well known Ball Swivel Joint (not shown) located just beneath nut 48, FIG. 3, the axle 71 is both advantageously mounted and the board performs well. Such a technique also prevents the rubber bushing 40 from excessive wear. My desired rotating motion of axle 71, however, is still available and board 50 exhibits the walking movement described above for FIG. 5.

Figure 4A:
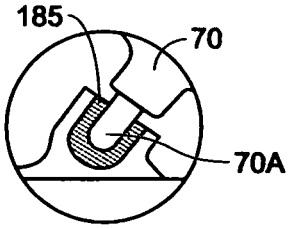

Turning to the enlargement of FIG. 4A, as the user shifts his/her weight on the board, the twist by weight shift is actually directed at an angle downward. It is not, however, straight down. A ball and socket type mounting 185 in bracket 42 takes advantage of this angled twist by employing a pivot, or cup, bushing shown in cross section in FIG. 4A. Bushing 185 forms the circular socket element in a ball and socket type mounting assembly as shown figuratively in FIG. 4A. The lowest end 70A of mounting stud 70 is rounded on the mounting end. That rounded end 70A sits in a mating rubber cup or pivot bushing 185 as shown in the enlargement of FIG. 4A. Together they absorb the angled downward thrust of the rider's weight shifts.

Protruding outwardly from the center of the cross axle is a pivot stem 70 with a rounded pivot ball 185 shown partially in black cross hatching surrounding stub 70. This rounded ball is seated in a rubber lined cup 185 secured within the fastening bracket 42. The rubber lined cup 185 acts as a side thrust absorbing structure. Pivot stem 70A and its rounded ball and socket type junction 185 serve an important role in responding to the twisted force resulting from a weigh shift by the rider. This pivot ball-and-cup 70, 185 provides relative movement for the axle 71 as a rider weight shift takes place. To the hand touch, the axle 71 feels rigid, but when the rider weight shift on the board 50 takes place, a great deal of force is transmitted to the axle 71 and the cone bushing 185.

In FIG. 3, a rearward leaning centering stud 49 leans toward the back of the board and helps support the cross axle 71 in proper position for holding a pair of rear caster wheels 80 and 90. This cross axle 71, for centering purposes, is hung on a single cone bushing 40 made of hard rubber, or other firm but yieldable substance. Top nut 48, when sufficiently tightened during assembly, evenly compresses the rubber bushing 40 beneath the cross axle 71 and holds axle 71 firmly in place.

Please note cone bushing 40, FIG. 4, which normally is evenly balanced at an initial centered position ie. a position that is without any imbalance in weight on board 50. When a rider shifts his/her weight, however, one side of the cone bushing 40 is compressed and the other side simply follows (expands) along. The structure thus seeks to return-to center as described before. The centering axle hanger along axis 49 is forced back toward the normal balanced condition. Weight on the other side of board 50 does just the opposite to that described. In any event, the rubber cone bushing 40 tends to restore the axle 71 back to it original centered and balanced condition.

An added technical feature is the braking system 300 of this caster wheeled invention. A rear end section 310, FIG. 1, of the board 50 is separated from the rest of the board but yet is easily depressible by the user's weight. Brake actuation requires a downward force resulting from pressure, say by a user's heel. This tail section 310 of board 50 has affixed thereto a braking block 320, FIGS. 1,3, 7 which block 320 is spring loaded to normally be held in an upright position at an angle of about 45 degrees above the board's upper plane or deck as shown best perhaps in FIG. 1. When pushed downward, say by the rider's heel, the braking surface 310 is depressed through linkage 340, FIG. 7, and becomes essentially level with the plane of board 50. This braking system 300 still retains an overall streamlined appearance for the board while adding a valuable new and improved function and structure.

This braking block 320 is both hinged and spring loaded as depicted in FIG. 3. A double acting spring 330, FIG. 3, presses spring ends against both the braking tail section 310 and the rear end of primary board 50. Spring 330 is normally biased upward at a selected upward angle amount (say 20 to 30 degrees as shown in FIG. 1) for the braking block 320. That upward bias for spring 330 is overcome by the user's application of the brake assembly 300. Connecting linkages 340, FIG. 7, when pressed downward, forces the drag plug of block 320 into frictional contact with the surface 350 upon which the board 50 is operating. The frictional drag on block 320 against surface 350 stops board 50 safely and adds a valuable feature to my caster wheeled skateboard invention.

An added benefit of the drag plug 320 is that, when applied properly by the rider a momentary "brake" movement can also develop additional flexibility and maneuver-ability for this caster skateboard. For example, a momentary drag or "pop" brake force of plug 320 to surface 350, FIG. 7, allows the rider to perform additional extreme stunts. Braking system 300 thus provided increased safety and novel maneuverability while presenting a safe and efficient braking system for the board.

The invention provides many non obvious features and advantages over the prior art described above. Other novel features and advantages of this invention will readily become apparent in accordance with a brief summary of my inventive claims as set forth below.

What is claimed is:

1. A skateboard of a tear drop shape with said board having a front end, a rear end, a centerline that runs longitudinally the length of the board with front end and rear end mounting studs on said center line, said skateboard comprising:

said board having a single deck consisting of a unitary construction of rigid essentially unyielding material;

at least three caster wheels for said board with all of said wheels selected of the long caster variety wherein the distance between a mounting point for a caster wheel to the caster wheel axis is a distance of about 4 to 6 inches; and further wherein said at least three wheels are oriented from the bottom of said single board in the following manner:

a front caster wheel of said three is fixed on a front end mounting stud underneath the front end of said single unitary board and adapted with a swivel movement about the board's longitudinal line;

a cross arm axle mounted on said rear end mounting stud;

a pair of said long caster wheels spaced apart to form an opposed pair of rear caster wheels mounted on a cross arm axle for providing swivel movement of said pair of rear caster wheels about said rigid, unitary board's longitudinal axis; and spring loaded centering means incorporated within the swivel for each one of said caster wheels and said cross arm axle for maintaining said cross arm axle and said caster wheels in a neutral or in line position except during turns and maneuvers of said skateboard as initiated by a rider shifting his/her weight on said simile unitary board.

2. The skateboard of claim 1 further characterized in that said rear cross arm axle is swivel mounted for a limited range of motion on said rear mounting stud at the rear end of said skateboard, which rear stud leans toward the center of the board for increased maneuverability.

3. The skateboard of claim 1 further characterized in that: said front end mounting stud carries said one long caster wheel in front, which stud is also angled toward the center of the board, with both of said center-angled studs contributing to stability and versatility in turning and stunt performance with said skateboard.

4. The skateboard of claim 1 further characterized by said spring loaded centering means comprising:

a spring connected at a forward anchor location on said longitudinal axis at one end and to said cross arm axle at the other spring end to assure self centering for said rear caster wheels and said cross arm axle; and a skateboard braking mechanism formed at the rear end of said board, with said brake being normally biased in an upward non-braking position; but readily activated downward by the user's heel for braking purposes; and a frictional plug that is linked to said rear end of said single unitary board for providing a frictional drag as said plug is forced downward by the user into frictional contact against the surface upon which the skateboard is operated when said braking system is activated by the skateboard rider.

5. A skateboard comprising;

a single deck consisting of a unitary construction of rigid essentially unyielding material;

at least three caster wheels for said board with all of said wheels selected of the long caster variety wherein the distance between a mounting point for a caster wheel to the caster wheel axis is a distance of about 4 to 6 inches; and further wherein said at least three wheels are oriented from the bottom of said single board in the following manner:

a front caster wheel of said three is fixed on a front end mounting stud underneath the front end of said single unitary skateboard deck and adapted with a swivel movement about the board's longitudinal line a cross arm axle mounted on said rear end mounting stud;

a pair of said long caster wheels spaced apart to form an opposed pair of rear caster wheels mounted on said cross arm axle for providing swivel movement of said pair of rear caster wheels about said rigid, unitary board's longitudinal axis;

spring loaded centering means incorporated within the swivel for each one of said caster wheels and for said cross arm axle for maintaining said cross arm axle and said caster wheels in a neutral or in line position except during turns and maneuvers of said skateboard as initiated by a rider shifting his/her weight on said single unitary board;

a self centering spring connected at an anchor bracket along the longitudinal axis;

the skateboard further characterized by said other end of said centering spring is connected by a Y-shaped brace rigidly spanning across the rear cross axle with the open part of the Y shape being rigidly fixed to the rear long caster wheel pair;

a skateboard braking mechanism formed at the rear end of said board, with said braking mechanism being normally biased in an upward non-braking position; but readily activated downward by the user's heel for braking purposes; and a frictional plug that is linked to said rear end of said single unitary board for providing a frictional drag as said plug is forced downward by the user into frictional contact against the surface upon which the skateboard is operated when said braking system is activated by the skateboard rider.

6. The skateboard of claim 1 and further characterized in that said long casters traverse an uphill movement in response to weight applied to the skateboard and said weight and said uphill movement combine together and cause said caster wheeled skateboard to experience a forward direction force on said board.

7. The skateboard of claim 6 further characterized in that a user does not have to "shove" or "push off" in order to get the board moving; but rather:

the higher up hill each long caster wheel travels in response to the weight of the user, the more forward force the board experiences as the long caster wheels return to center by rider weight shifts on the upper deck of the board.

8. The skateboard of claim 7 further characterized by:

a dual mounting structure connected to the underside of said board for two distinct shafts;

one shaft is the mounting stud shaft that is located on a first axis that leans toward the center of the board: and a second shaft is in the form of a return-to-neutral king pin axis formed in said cross axle.

9. The skateboard of claim 8 further characterized by:

both of said mounting stud and said centering axes intersect one another at essentially a right angle.

10. The skateboard of claim 9 further characterized by:

a rubber bushing mounted on the king pin, which bushing is evenly compressed initially for a neutral position;

said bushing being compressible on one side or the other as weight shifts by the rider take place; and said bushing, when compressed, urges the king pin back to a neutral or balanced condition.

11. The skateboard of claim 10 further characterized by:

a caster wheel centering structure mounted in the swivel housings of each caster wheel for restricting the swiveling amount of said casters to less than about 90 degrees.

12. The skateboard of claim 11 further characterized by swivel bearing groups at each caster wheel and wherein certain bearings of each swivel bearing group comprise standard ball bearings, and further characterized in that:

one bearing of each swivel bearing group being a return to neutral bearing for assuring that its associated caster wheel is automatically returned to a neutral position after movement away therefrom in response to a riders weight shift on said board.

13. The skateboard of claim 12 further characterized by said return to neutral bearing comprising:

a pair of balanced springs such that, when either spring of the pair is compressed, such spring pair act together as a centering spring to move the associated caster wheel, back to a center or neutral position.

14. The skateboard of claim 1 further characterized by a dual mounting bracket defining two separate mounting axes oriented at about 90 degrees to one another, and wherein:

one axis lies along the rear mounting stud which holds said rear axle in place and the other axis lies along a shaft that houses said caster wheel centering device and wherein said second axis intersects with the first axis at about said ninety degrees.

15. The skateboard of claim 1 wherein a rider creates a twisting downward force when said board is in motion, and said pivot ball socket cup and said rounded ball end of said rear mounting stud provides some relative movement for the cross axle as said rider's weight shifts take place.

* * * * *